US006008608A

United States Patent [19]

Holsten et al.

[11] Patent Number: 6,008,608

[45] Date of Patent: Dec. 28, 1999

[54] USER OPERATED SWITCH AND SPEED CONTROL DEVICE FOR A WET/DRY VACUUM

[75] Inventors: Stuart V. Holsten, O'Fallon, Mo.; Joseph T. Gierer, Glen Carbon, Ill.; Karmen D. Cox, St. Peters; James I. Metzger, Jr., Ballwin, both of Mo.

[73] Assignee: Emerson Electric Co., St. Louis, Mo.

[21] Appl. No.: 08/844,075

[22] Filed: Apr. 18, 1997

[51] Int. Cl.[6] ..... H01H 39/42

[52] U.S. Cl. ..... 318/544; 318/549; 200/564; 200/573; 200/11 TW

[58] Field of Search ..... 318/600–605, 318/779, 784, 543–557; 200/564–574, 11 TC, 11 TW, 332.2, 61.85; 387/824, 827, 838–841, 916, 937

[56] References Cited

U.S. PATENT DOCUMENTS

| | | | |
|---|---|---|---|
| 3,721,879 | 3/1973 | Corey et al. | 388/830 |
| 3,857,076 | 12/1974 | Hetland | 318/257 |
| 3,872,420 | 3/1975 | Koch et al. | 338/162 |
| 3,919,510 | 11/1975 | Barnes | 200/61.88 |
| 4,357,729 | 11/1982 | Molen et al. | 15/319 |
| 4,549,097 | 10/1985 | Ulmer . | |
| 4,920,606 | 5/1990 | Gerke, Jr. et al. | 15/338 |
| 5,038,084 | 8/1991 | Wing | 318/268 |
| 5,300,918 | 4/1994 | Becker . | |
| 5,455,886 | 10/1995 | Glenn, III et al. | 388/838 |
| 5,504,971 | 4/1996 | McCormick | 15/340.2 |
| 5,542,921 | 8/1996 | Meyers et al. | 604/74 |

OTHER PUBLICATIONS

J. C. Compter, "Microprocessor–ControlledSingle–Phase Reluctance Motor," in *Switched Reluctance Motor Drives,* pp. 233–237, ed. T. J. E. Miller, Pub. Intertec Communications Inc., Ventura, California, Oct., 1988.

"Craftsman® Wet/Dry Vacs and Accessories," pp. 146–148, undated.

"McGill® 4775–Series Rolling Cam Snap–Action Switches," p. 14, undated.

*Primary Examiner*—Brian Sircus

*Attorney, Agent, or Firm*—Arnold White & Durkee; Mark L. Gleason

[57] ABSTRACT

A switch and speed control assembly for use in a wet/dry utility vacuum or blower is disclosed. The switch and speed control assembly provides a single rotary control actuator for turning the vacuum or blower on and off, for infinitely varying the speed of the motor, and for providing a momentary boost control. The switch and speed control assembly includes a thumb wheel fitted to the shaft of a voltage varying potentiometer, a snap action switch in operable relation to the exterior edge of the thumb wheel, and a compression spring contained beneath the thumb wheel. As the thumb wheel is rotated in an increasing "on" direction, the contacts of the snap action switch are closed, allowing electric current to flow to the motor of the wet/dry utility vacuum or blower. The voltage levels in the motor, and correspondingly the speed of the motor, are controlled by varying the potentiometer voltage through rotation applied to the thumb wheel. During boost operating conditions, the thumb wheel engages the compression spring such that when the force engaging the momentary boost condition abates, the thumb wheel returns to a normal operating condition. Additional features incorporated in the switch and speed control assembly include: mechanical stops for both the "Off" and "High On" modes; a static guard to protect the electrical components and the user from static discharges; fastener free mounting within wet/dry utility vacuum or blower housings; a configuration designed to prevent mechanical loads present on the thumb wheel from being transferred to the potentiometer shaft and other electrical components, such as the switch; and internal wire routing designed to minimize inductive influences between the wires.

25 Claims, 9 Drawing Sheets

USER OPERATED SWITCH AND SPEED CONTROL DEVICE FOR A WET/DRY VACUUM

FIELD OF THE INVENTION

The present invention relates generally to a switch and speed control device for electronically controlling the operation of a wet/dry utility vacuum cleaner or blower motor or similar machine. In particular, the invention provides a single control for turning a vacuum or blower on and off, infinitely varying the speed of the motor, and momentarily boosting the performance of the unit.

BACKGROUND OF THE INVENTION

While it is known to provide a thumb wheel type control for variable speed adjustment of the vacuum or blower motor during operation, prior art wet/dry utility vacuums and blowers typically provide separate toggle type switches for turning the unit on and off. Operation of these switches requires the user to reposition the hand, making it inconvenient.

Additionally, the use of current thumb wheel controls often involves directly mounting the thumb wheel to the shaft of a potentiometer that is used to vary the speed control. Such a mounting traditionally requires the potentiometer to absorb the force of impacts and thumb (or finger) pressure, often resulting in a shortened operating life and premature fracture. It is known to protect the potentiometer from such forces by including additional moving parts such as slide mechanisms or gearing that isolate the potentiometer from the thumb wheel. However, such additional parts add to the switch assembly complexity and increase manufacturing costs.

It is further known to eliminate the separate on/off toggle switch and provide a potentiometer with a built-in switch feature, so as to activate current flow through the potentiometer upon rotation of the potentiometer shaft by a thumb wheel as described above. However, the built-in switches present on potentiometers do not meet the high current requirements for wet/dry utility vacuums or blowers.

The present invention is directed to minimizing or eliminating these drawbacks.

SUMMARY OF THE INVENTION

The present invention is directed to a switch and speed control assembly that is capable of turning a vacuum or blower on and off, infinitely varying the speed of the motor, and momentarily boosting the performance of the unit utilizing a single rotary actuated control. The invention prevents potentiometer damage without additional mechanisms and provides improved features for facilitating the operation of wet/dry utility vacuums and blowers.

The switch and speed control assembly according to the present invention includes a control member which is preferably a thumb wheel fitted to the shaft of a voltage varying potentiometer, a snap action switch in operable relation to the exterior edge of the thumb wheel, and a boosting device including a compression spring actuated by the thumb wheel. As the thumb wheel is rotated in an increasing "on" direction, the contacts of the snap action switch are closed, allowing electric current to flow to the motor of the wet/dry utility vacuum or blower. The voltage levels in the motor, and correspondingly the speed of the motor, are controlled by varying the potentiometer voltage through rotation applied to the thumb wheel. During boost operating conditions, the thumb wheel engages the compression spring such that when the force engaging the momentary boost condition abates, the thumb wheel returns to a normal operating condition. Additional features incorporated in the switch and speed control assembly include: mechanical stops for both the "Off" and "High On" modes; a static guard to protect the electrical components and the user from static discharges; fastener free mounting within wet/dry utility vacuum or blower housings; a configuration designed to prevent mechanical loads present on the thumb wheel from being transferred to the potentiometer shaft and other electrical components, such as the switch; and internal wire routing designed to minimize inductive influences between the wires.

In another aspect of the present invention, a method is provided for controlling a user operated electric motor which includes the steps of turning the motor on and off with a switch activated by a control member and varying the speed of the motor within a predetermined range once the motor is turned on using a voltage varying device activated by the control member. The predetermined range is preferably between 13,000 and 17,000 revolutions per minute ("rpm") when the airflow path of the vacuum or blower used in performing this method is unobstructed. The preferred method includes the step of increasing the speed of the motor above the predetermined range with the assistance of a boosting device activated by the control member when momentary boosts in motor speed are desired.

DETAILED DESCRIPTION OF THE PREFERRED EMBODIMENTS

Figure 1:
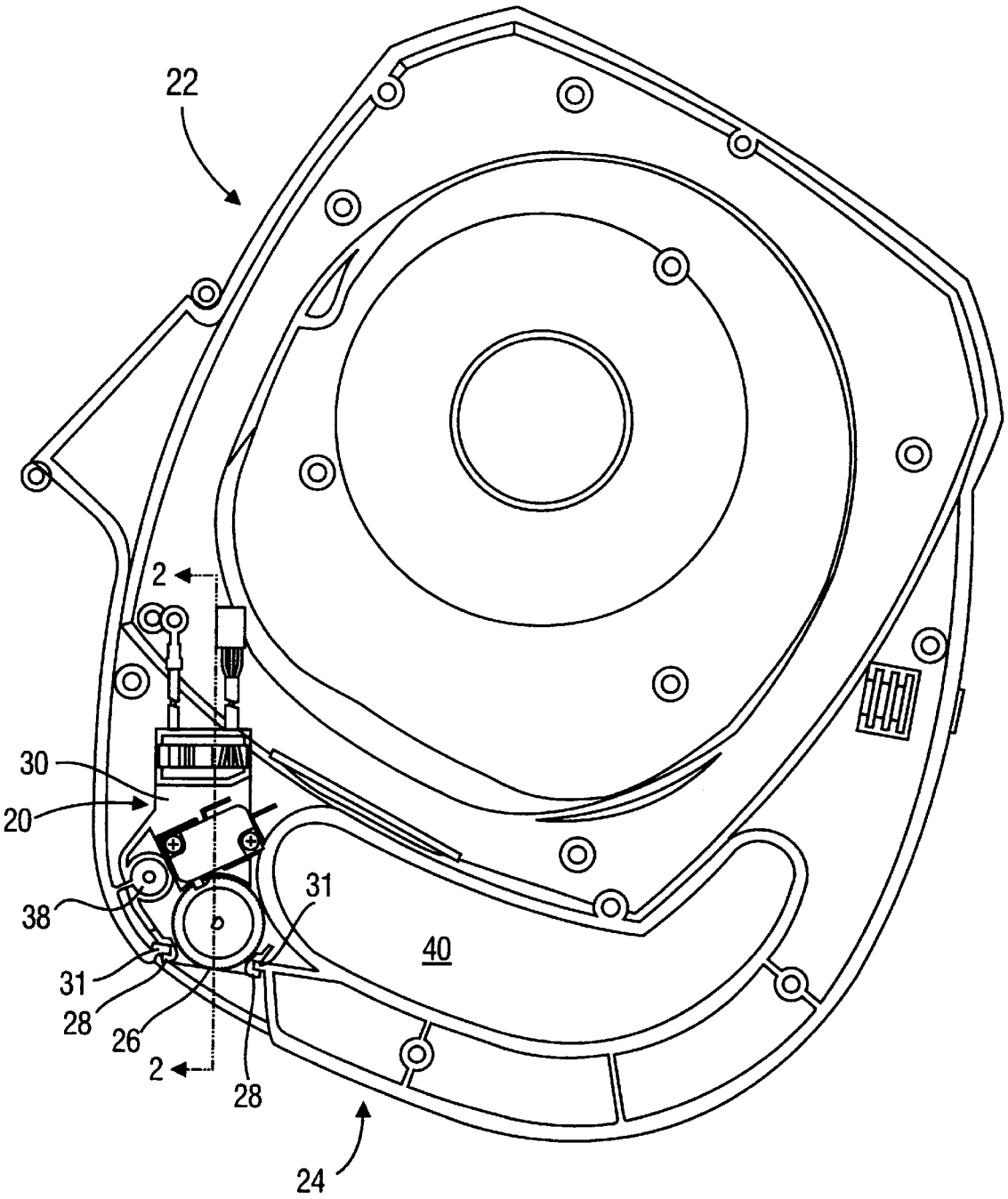
FIG. 1 is a top view of the switch and speed control assembly of the present invention installed in a lid-detachable housing of a wet/dry utility vacuum cleaner or blower.

Turning now to the drawings and referring initially to FIG. 1, a switch and speed control assembly 20 according to the present invention is shown. The front edge of the switch and speed control assembly 20 is positioned within the base of a housing is handle 24 such that a thumb wheel 26 extends just beyond a control assembly retaining lip 28 for easy manipulation by the thumb (or any finger) of a user grasping the housing handle 24. A control assembly mounting plate 30 serves as the switch and speed control assembly 20 support structure. Otherwise, the switch and speed control assembly 20 is installed without fasteners in a lid-detachable housing 22.

The control assembly mounting plate 30 is constructed as a one-piece molded unit from rigid plastic or other similar suitable material, and is shaped to fit within the contours of a lid detachable housing 22, as seen in FIG. 1. Control assembly mounting plate 30 includes an upper box-shaped support structure 32 (shown in FIG. 6), and two lower support ribs 34 (shown in FIG. 11). Control assembly mounting plate 30 also includes support ribs 27A and 27B (shown in FIG. 11), and control assembly retaining lips 28 (shown in FIGS. 6 and 11) which are molded into the front edge and sides of plate 30. Upper box-shaped support structure 32 and lower support ribs 34 prevent vertical motion of the control assembly mounting plate 30, while control assembly retaining lips 28 and support ribs 27A and 27B slide-fit with a protruding rib 22A of the lid-detachable housing 22 to preventing longitudinal motion (shown in FIG. 2). Lateral motion of the switch and speed assembly is prevented by the slots 28B and 28C of the control assembly mounting plate 30 which are slide fitted around ribs 31 of the lid-detachable housing 22 (shown in FIG. 1). Lateral and longitudinal motion of the switch and speed control assembly is further prevented by cavity 29 (shown in FIG. 5), which is slide fitted around retaining post 38 (shown in FIG. 1).

Figure 4:
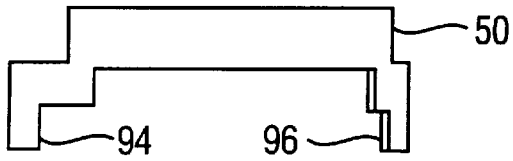
FIG. 4 is a side view of the static guard for the switch and speed control assembly, illustrating the location of two static guard bend tabs.
Figure 5:
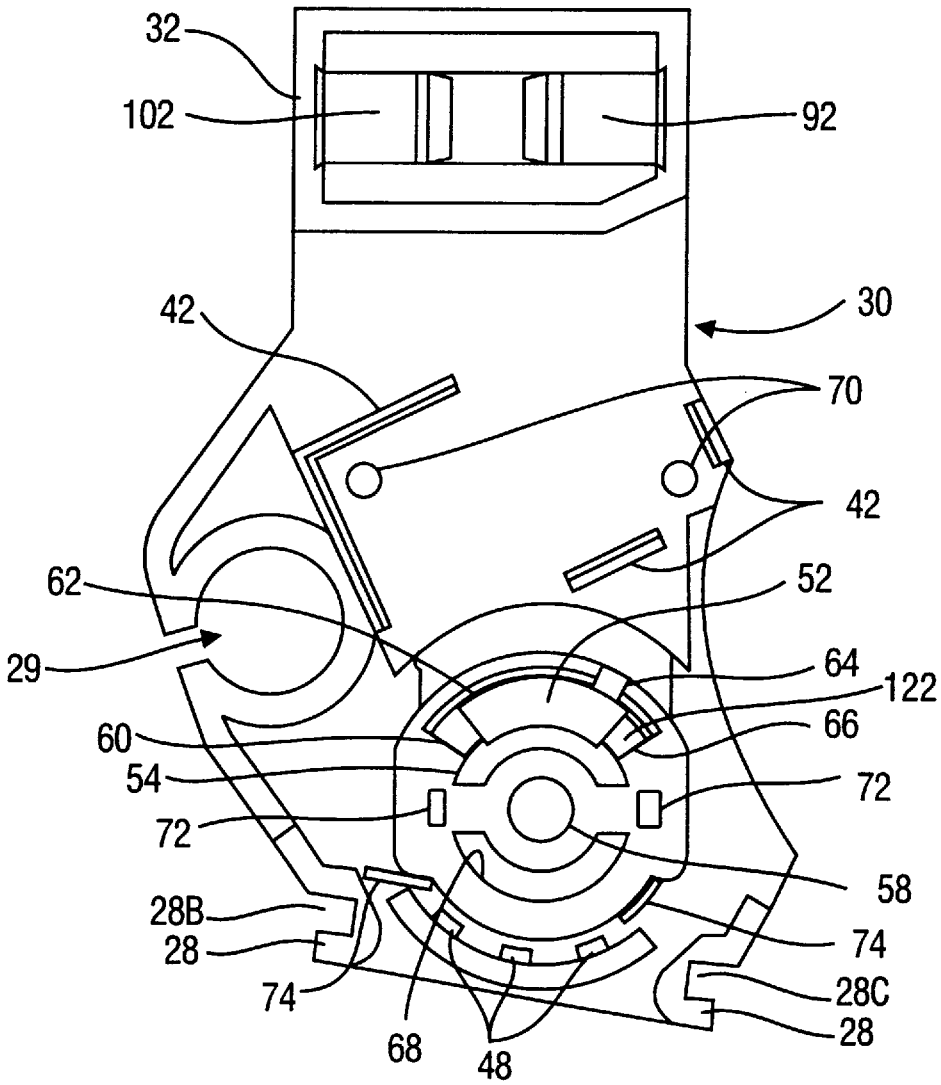
FIG. 5 is a top view of a control assembly mounting plate for the switch and speed control assembly.
Figure 6:
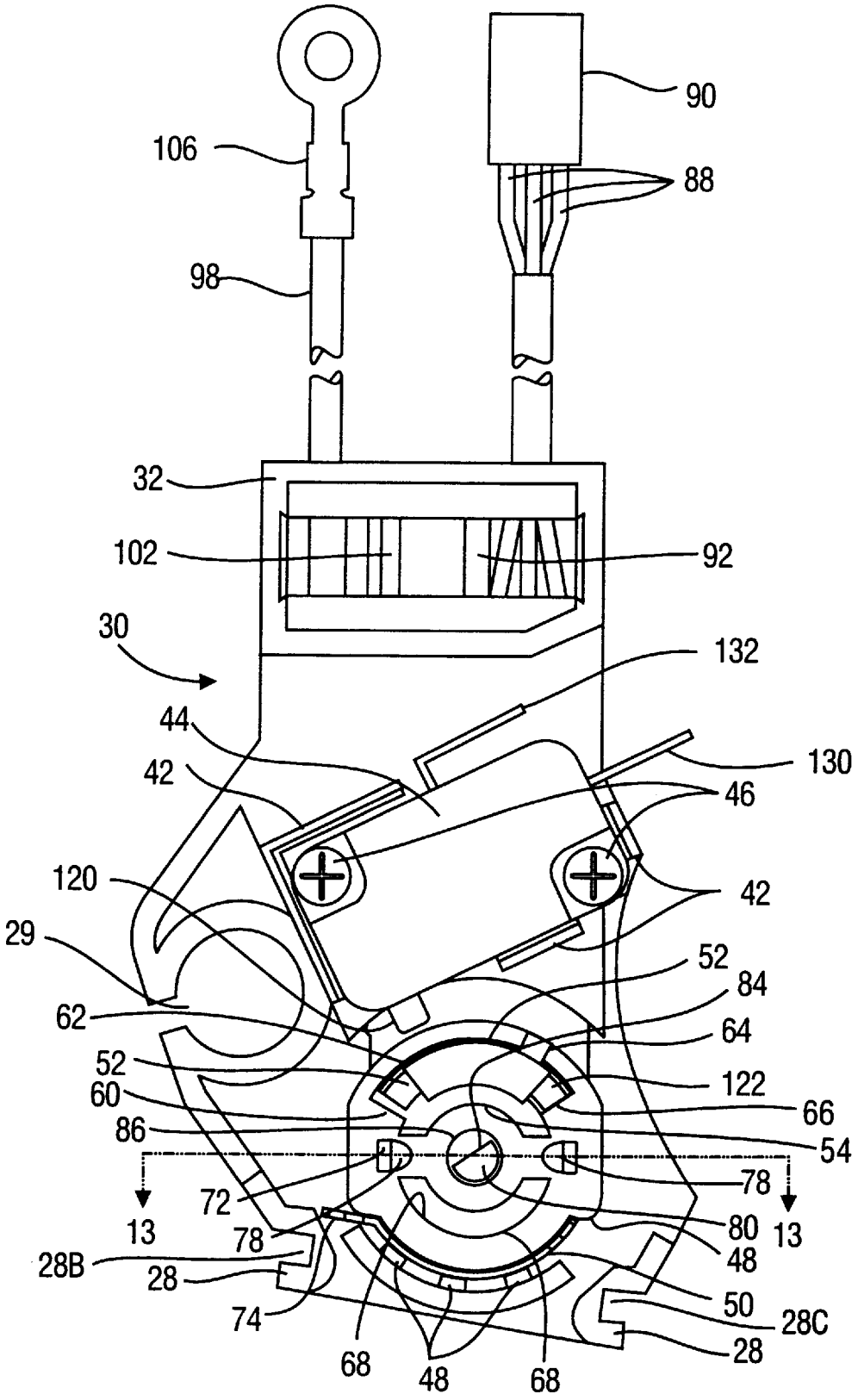
FIG. 6 is a top view of the switch and speed control assembly, showing the snap action switch installed on the control assembly mounting plate, with the thumb wheel and compression spring removed for clarity.

The upper surface of the control assembly mounting plate 30 is shown in FIGS. 5 and 6. A plurality of raised switch guide ribs 42 (preferably three) are used to position a snap action switch 44 (shown in FIG. 6) onto the assembly mounting plate 30. Screw receptacles 70 pass through the control assembly mounting plate 30 to receive screws 46 when the snap action switch 44 is fastened to the plate. Three static guard retaining ribs 48 are provided to hold the curved portion of a static guard 50 (shown in FIGS. 3 and 4) parallel to the inner surface of the thumb wheel 26 and to prevent static guard 50 interference with thumb wheel 26. Bend tabs 94 and 96 of the static guard 50 (shown in FIG. 4) slip into static guard bend tab receiving slots 74 (shown in FIG. 5) which pass through the control assembly mounting plate 30 to secure the static guard 50 to the plate when bend tabs 94 and 96 are bent (shown in FIG. 11) to affix the static guard 50 to the plate. The static guard 50 is provided to protect the electrical components and the user from static discharges.

Figure 10:
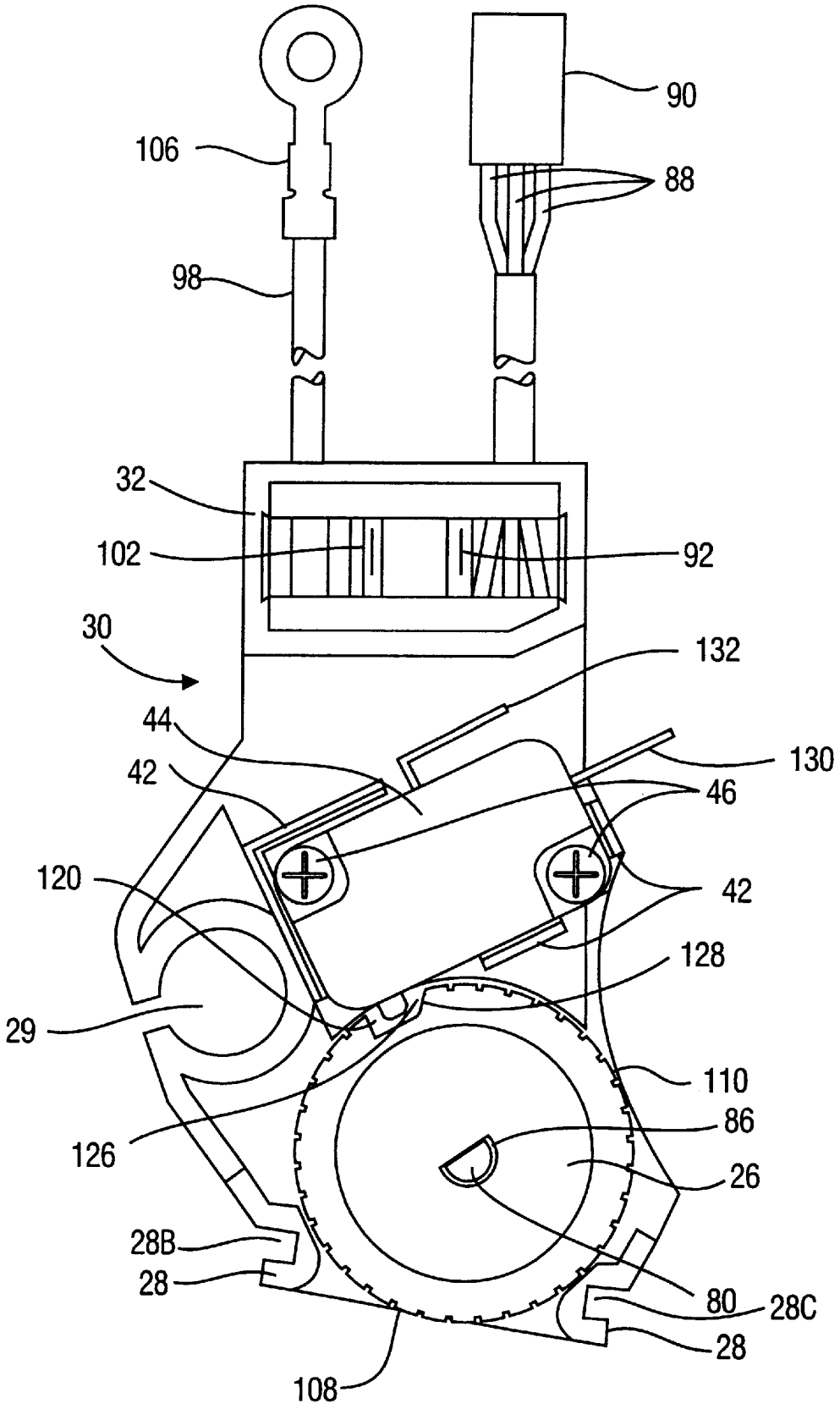
FIG. 10 is a top view of the switch and speed control assembly with the thumb wheel in the "Off" position.

Potentiometer bend tab receiving slots 72 are likewise used to affix a potentiometer 76 to the control assembly mounting plate 30. FIG. 6 shows the upper surface of the control assembly mounting plate 30 with the potentiometer 76, the static guard 50, and the snap action switch 44 in place. The assembly of the potentiometer 76 and the static guard 50 will be discussed in more detail herein. FIG. 10 shows the addition of the thumb wheel 26.

Figure 2:
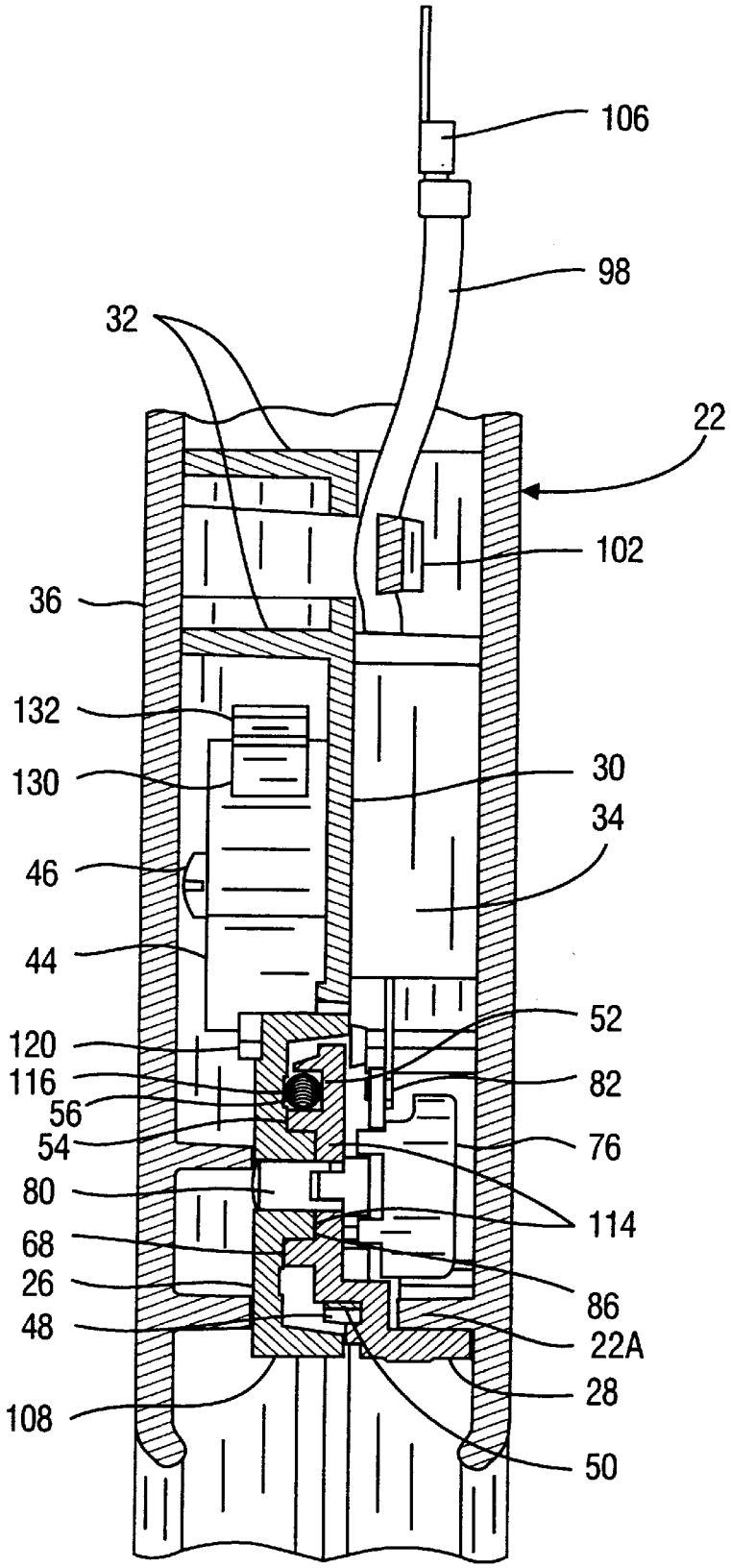
FIG. 2 is a cross-sectional view of the switch and speed control assembly installed between the lid-detachable housing and motor cover of a wet/dry utility vacuum cleaner or blower, as viewed along line 2—2 of FIG. 1.
Figure 15:
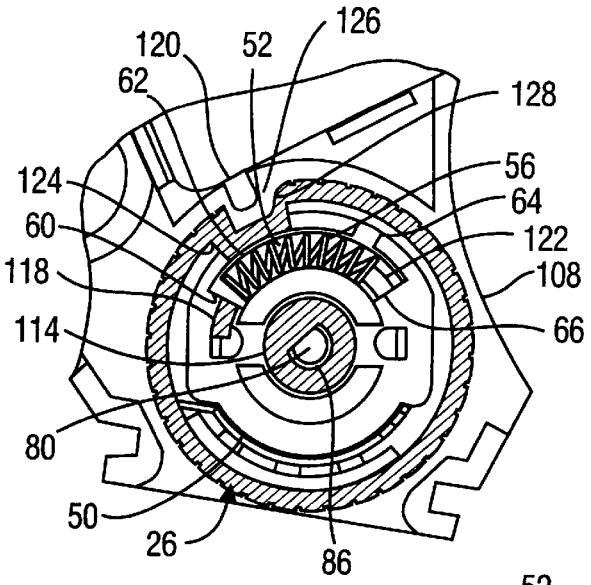
FIG. 15 is a cross-sectional view of the switch and speed control assembly as viewed along line 15—15 of FIG. 14, illustrating the interaction of the compression spring, snap action switch, and the thumb wheel in the "Off" position.

Also molded into the upper surface of the control assembly mounting plate 30 is a spring receiving slot 52, formed adjacent a rear thumb wheel bearing 54, as shown in FIGS. 5 and 6. Spring receiving slot 52 retains a compression spring 56 (shown in FIGS. 15–17) in a position such that the compression spring 56 may exert a counter-rotational force on thumb wheel 26 during the boost or "High-On" condition. Spring receiving slot 52 is concentric to potentiometer shaft opening 58, which passes through the control assembly mounting plate 30. Compression spring 56 is compressed, or pre-loaded and placed within spring receiving slot 52, as is best shown in FIG. 15. Composed preferably of music wire, a suitable compression spring 56 will have a spring rate of approximately 4.1 pounds per inch, and a free length of approximately 0.62 inches. Compression spring 56 is fully enclosed within the arc shaped spring receiving slot 52 and is held in place by the underside of thumb wheel 26, as shown in FIG. 2.

Raised edges, or "ribs," are also molded into the upper surface of the control assembly mounting plate 30, as shown in FIGS. 5–6, and 15–17. "Off" rib 60 provides a mechanical stop when the thumb wheel 26 is in the "Off" position. The "High-On" rib 64 provides a mechanical stop when the thumb wheel 26 is in the maximum "High-On" position. Furthermore, spring retaining rib 66 and spring retaining wall 62, along with "Off" rib 60 and rear thumb wheel bearing 54, help keep compression spring 56 in place within the spring receiving slot 52. Rear thumb wheel bearing 54 comprises the inner edge of spring receiving slot 52. In conjunction with front thumb wheel bearing 68 located on the opposite side of potentiometer shaft opening 58, rear thumb wheel bearing 54 provides support for thumb wheel 26. The action of the various "ribs" will be described in more detail herein.

Figure 7:
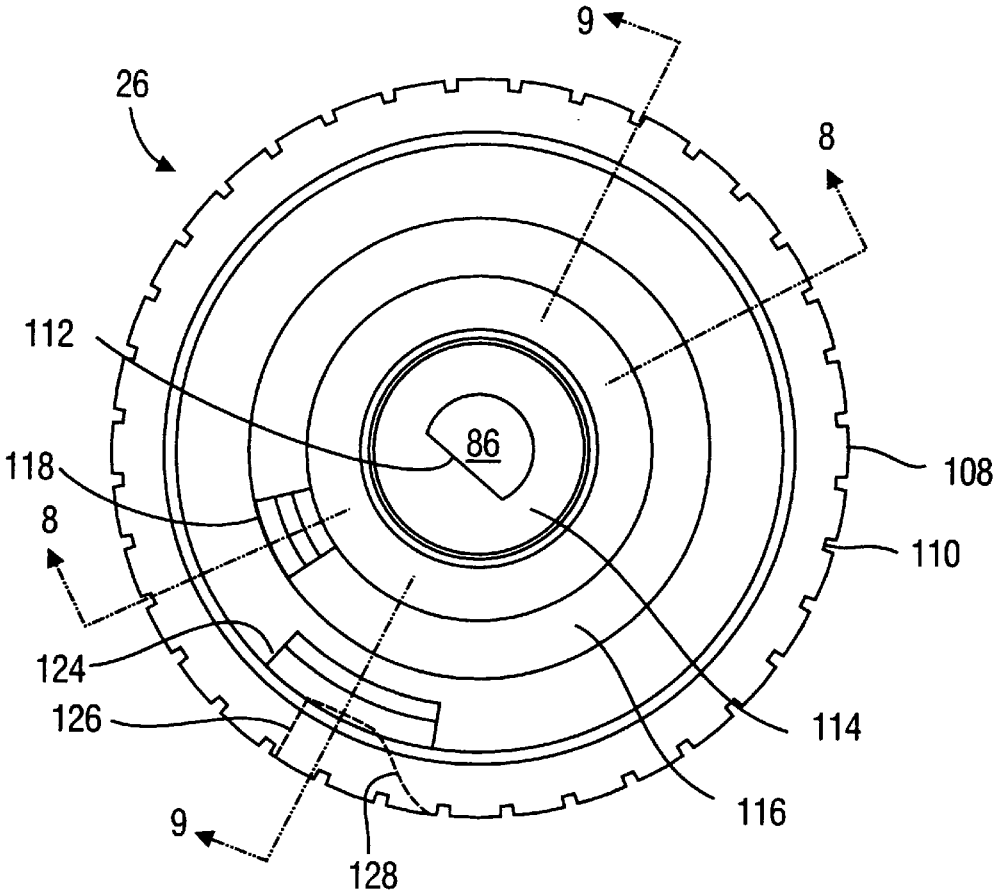
FIG. 7 is an underside view of the thumb wheel.
Figure 13:
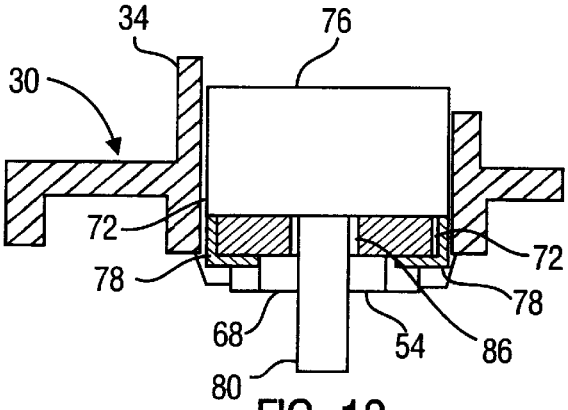
FIG. 13 is a cross-sectional view of the switch and speed control assembly as viewed along line 13—13 of FIG. 6, showing the potentiometer installed on the control assembly mounting plate.

Referring generally to FIGS. 6 and 13, potentiometer 76 is secured to the is underside of control assembly mounting plate 30 by two potentiometer bend tabs 78 passing up through the potentiometer bend tab receiving slots 72. Potentiometer bend tabs 78 bend over the upper surface of the control assembly mounting plate 30, securing potentiometer 76 to the underside of control assembly mounting plate 30 such that potentiometer 76 may rock slightly in response to applied force, thereby preventing damage. Potentiometer 76 is preferably of the voltage varying type, such as type TPM270, part number 270-YW1260, commercially available from CTS Corp. of Elkhart, Ind. In addition to bend tabs 78, potentiometer 76 includes a flat-faced potentiometer shaft 80 with 300 degrees of rotation angle between the minimum and maximum voltage positions, and three potentiometer solder lugs 82 (FIG. 11) for electrical connections. As is best shown in FIG. 13, potentiometer shaft 80 extends upward from potentiometer 76 through potentiometer shaft opening 58 and terminates beyond thumb wheel bearings 68 and 54. This allows thumb wheel 26, the underside of which is shown in FIG. 7, to be pressed onto the potentiometer shaft 80 during manufacture of the switch and speed control assembly 20. According to the disclosed design, bearings 54 and 68 has been split in order to accompany the potentiometer bend tabs 78. If the potentiometer 76 is connected with the control assembly mounting plate 30 in an alternative fashion, bearings 54 and 68 can be combined into one continuous bearing.

Figure 11:
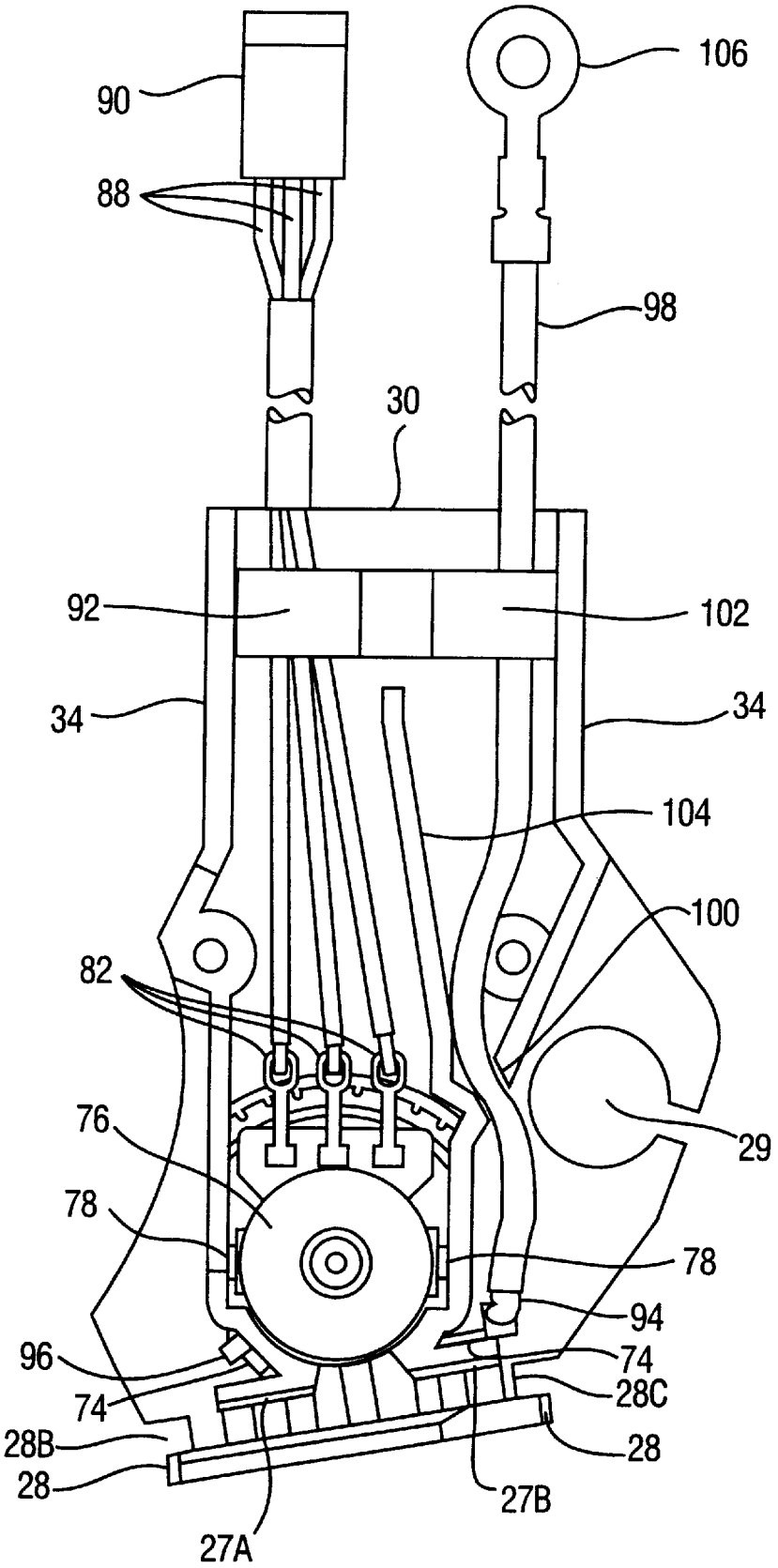
FIG. 11 is a bottom view of the switch and speed control assembly.

FIG. 11 shows the lower surface of the control assembly mounting plate 30 with the potentiometer 76 fastened into place. Three individual control wires 88 transmit electrical signals between the potentiometer 76 and the electrical system of the wet/dry utility vacuum or blower. The magnitude of the electrical signal present on control wires 88 is proportional to the extent of the rotation of potentiometer shaft 80. At one end, the control wires 88 are solder connected to corresponding potentiometer solder lugs 82 and are retained in place on the underside of the control assembly mounting plate 30 by control wire snap strain relief 92. At the other end, the control wires 88 terminate in a control cord assembly 90, which is a connector suitable for snap connection to a matching connector in the electrical system of a wet/dry utility vacuum or blower.

Figure 12:
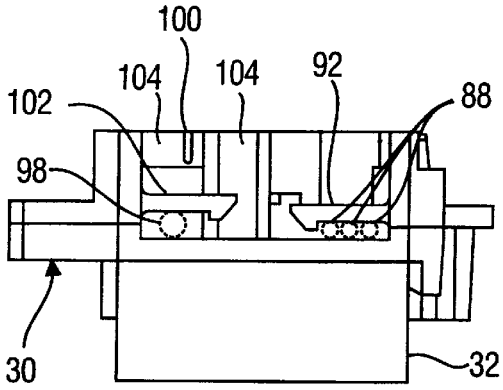
FIG. 12 is an end view of the control assembly mounting plate for the switch and speed control assembly with the positions of a ground lead wire and control wires shown in phantom.
Figure 14:
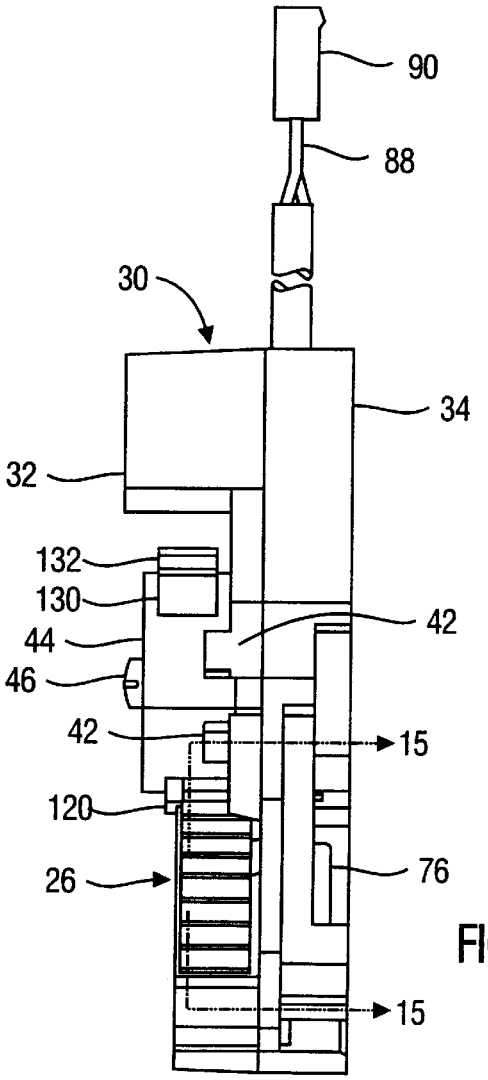
FIG. 14 is a side view of the switch and speed control assembly.

A ground lead wire 98 is also provided which passes through a ground wire slot 100 in lower support rib 34 and is restrained in place by ground wire snap strain relief 102, as shown in FIG. 11. To prevent inductive coupling of noise or transients with the control wires 88, the ground lead wire 98 is separated from control wires 88 by a ground wire guide rib 104 molded into the lower surface of the control assembly mounting plate 30. The ground lead wire 98 terminates at ground wire connector 106. FIG. 12 shows the control wires 88 and ground lead wire 98 in phantom, passing under control wire snap strain relief 92 and ground wire snap strain relief 102, respectively.

Upon completion of the potentiometer 76 attachment to the control assembly mounting plate 30 as described above, static guard 50 and compression spring 56 must be installed prior to installation of thumb wheel 26, as these components are both fully enclosed beneath the thumb wheel 26, as best shown in FIG. 2.

Figure 3:
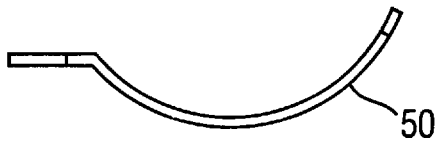
FIG. 3 is a top view of the static guard for the switch and speed control assembly.

The static guard 50, shown in FIGS. 3 and 4, is constructed of an electrically conductive material, preferable copper or similar metal, and is positioned adjacent to static guard retaining ribs 48, as shown in FIG. 6. Static guard retaining ribs 48 support static guard 50 laterally, and prevent interference with the inner surface of thumb wheel 26, as shown in FIG. 2. The static guard 50 is secured firmly in place by the left static guard bend tab 94, and the right static guard bend tab 96, each passing through corresponding static guard receiving slots 74 and bending over the underside of the control assembly mounting plate 30, as best seen in FIG. 11. Solder is used to connect the left static guard bend tab 94 to the ground lead wire 98, which is connected to the ground wire of the electrical cord (not shown). In this manner, the static guard 50 acts to conduct static discharges from thumb wheel 26 and the user's hand, and to prevent discharges from entering the electronics of the vacuum.

Referring to FIG. 7, thumb wheel 26 is preferably constructed as a one-piece unit from a durable plastic or similar material. Thumb wheel 26 is essentially disc-shaped. Spaced equidistantly around the perimeter of the thumb wheel outside wall 108 are a plurality of texture grooves 110, which serve to provide the user with a tactile control surface. Centrally located within the thumb wheel 26 is a shaft opening 86 that passes through the thumb wheel 26 and is sectionally shaped with a flattened shaft wall 112 to correspond to the flattened shaft face 84 (FIG. 6) of the potentiometer shaft 80 for press fitting thereon. In addition, the flattened shaft wall 112 ensures that as thumb wheel 26 is rotated in an increasingly "On" direction, potentiometer shaft 80 rotates as well, directly increasing the voltage supplied to the control cord assembly 90 through the control wires 88. Rotating thumb wheel 26 in the opposite direction reverses the effect.

A thumb wheel journal 114 formed on the underside of the thumb wheel 26 surrounds the shaft opening 86 and fits between the front thumb wheel bearing 68 and the 11 rear thumb wheel bearing 54 on the upper surface of the control assembly mounting plate 30, stabilizing and guarding snap action switch 44 and potentiometer shaft 80 against the force of impacts and thumb (or finger) pressure. As shown in FIG. 2, the close fit between the thumb wheel journal 114, and thumb wheel bearings 68 and 54, along with is the close fit between the shaft opening 86 and the potentiometer shaft 80, serves to secure the thumb wheel 26 to the switch and speed control assembly 20. Because the thumb wheel 26 is only press-fitted on shaft 80, the thumb wheel 26 is secured into position by the cover 36.

The thumb wheel 26 is also provided with a compression spring indentation 116, as shown in FIG. 7. When the thumb wheel 26 is fastened to the potentiometer shaft 80, a part of the compression spring 56 lies in the compression spring indentation 116, as shown in FIG. 2. The compression spring indentation 116 traverses approximately 340 degrees of arc around the undersurface and provides clearance for the thumb wheel 26 to pass over compression spring 56 during rotation. The remaining approximately 20 degrees of arc is occupied by a spring actuating member 118, as shown in FIG. 7.

Figure 8:
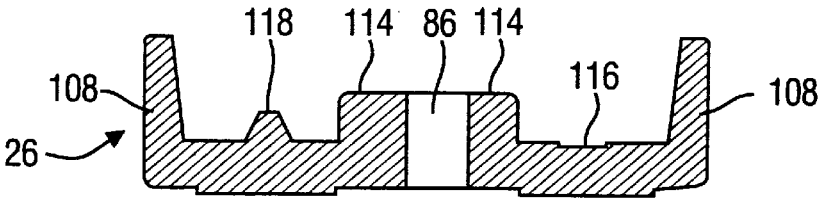
FIG. 8 is a cross-sectional view of the thumb wheel taken along line 8—8 of FIG. 7, illustrating the sectional shape of a spring actuating member and thumb wheel journal.
Figure 9:
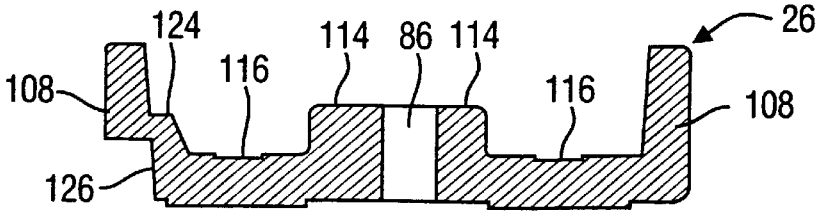
FIG. 9 is a cross-sectional view of the thumb wheel taken along line 9—9 of FIG. 7, illustrating the sectional shape of a switch indentation and thumb wheel "HighOn" stop.

Spring actuating member 118 appears sectionally as a truncated triangle protruding from the underside of thumb wheel 26, as best seen in FIG. 8. While this design is preferable, one of ordinary skill will realize that many other designs of spring actuating member 118 are possible which will also adequately perform the function of member 118, including a pin or other extension attached to or formed in the thumb wheel 26.

The rear face of the spring actuating member 118 is positioned in the circumference of the compression spring indentation 116 such that when thumb wheel 26 is rotated to the "Off" position (i.e., when the potentiometer shaft 80 is at the minimum voltage position), the rear face of spring actuating member 118 contacts the leftmost edge of the "Off" stop rib 60 of the control mounting plate 30. This contact, best seen in FIG. 15, provides a mechanical stop, preventing over-rotation of the thumb wheel 26 and potentiometer shaft 80, or damage to the plunger 120 of snap action switch 44 by excessive force.

Figure 16:
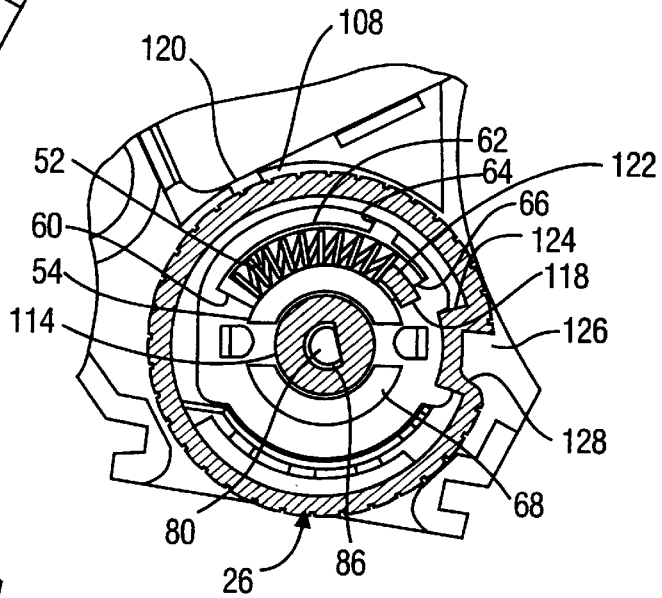
FIG. 16 is a cross-sectional view of the switch and speed control assembly as viewed along line 15—15 of FIG. 14, illustrating the interaction of the compression spring, snap action switch, and the thumb wheel in the "Normal High-On" position.

The front face of spring actuating member 118 is positioned such that when thumb wheel 26 is rotated to the "Normal High-On" position, the front face of spring actuating member 118 enters the sectionally matching actuating rib opening 122 in the spring retaining rib 66 and contacts one end of compression spring 56, as best seen in FIG. 16. Since the compression spring 56 is pre-loaded the thumb wheel 26 will not move beyond the "Normal High-On" position unless thumb or finger force is applied to the thumb wheel.

Figure 17:
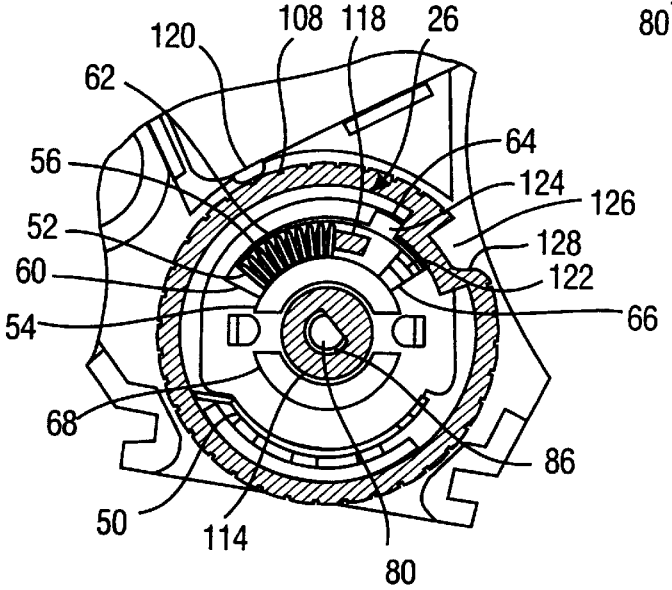
FIG. 17 is a cross-sectional view of the switch and speed control assembly as viewed along line 15—15 of FIG. 14, illustrating the interaction of the compression spring, snap action switch, and the thumb wheel in the "High-On" position.

When the thumb wheel 26 is rotated beyond the "Normal High-On" position, the "High-On" condition is encountered. In this condition, the spring actuating member 118 compresses the compression spring 56 more within the spring receiving slot 52. This compression results in a counter-rotational force being exerted against the spring actuating member 118 by the compression spring 56. FIG. 17 represents the maximum rotation position of thumb wheel 26 and potentiometer shaft 80, and shows compression spring 56 under compression from spring actuating member 118. When the rotational force imparted by a thumb or finger is removed, the compression spring 56 expands, returning to the maximum confines of the spring receiving slot 52, restoring thumb wheel 26 and potentiometer shaft 80 to the "Normal High-On" position shown in FIG. 16.

Referring again to FIG. 17, a "High-On" stop is provided by the interaction of "High-On" stop rib 124 (FIG. 7) and "High-On" rib 64. "High-On" stop rib 124 is preferably located 12.1 degrees of arc counterclockwise, as viewed from the perspective of FIG. 7, from the rear face of the spring actuating member 118, and should encompass approximately 35 degrees of arc. Also, the "High On" stop rib 124 should be shaped to prevent interference with the spring retaining wall 62 during rotation of the thumb wheel 26. In addition to providing a stop, "High-On" stop rib 124 provides structural integrity to the thumb wheel outside wall 108 by forming the back side of the switch indentation 126.

As an alternative embodiment, compression spring 56 need not be used. In this case, the thumb wheel 26 will experience no counter-rotational force, and will be allowed to move freely until the "High-On" stop rib 124 (FIG. 7) engages the "High-On" rib 64. In this embodiment, the "Normal High-On" and "High-On" modes of operation are effectively merged into one mode. As such, the existence of the compression spring 56 is not necessary to the practice of the disclosed invention. Additionally, one of ordinary skill will recognize that other means could be used other than compression spring 56 to provide a counter-rotational force against the thumb wheel 26 when it is in the "High-On" position.

Switch indentation 126 is positioned such that when thumb wheel 26 and potentiometer shaft 80 are in the "Off" position (FIG. 15), plunger 120 of the snap action switch 44 is fully extended within the switch indentation 126 of thumb wheel 26. The depth of switch indentation 126 rapidly and smoothly decreases along an engaging edge 128 opposite the direction corresponding to the increasing "On" rotation of thumb wheel 26. A perpendicular edge forms the side opposite engaging edge 128. When in the "Off" position, the edges of switch indentation 126 are prevented from contacting plunger 120 by the interaction of the rear face of spring actuating member 118 and the rear edge of the "Off" stop rib 60 as described above, and best seen in FIG. 15. Avoiding contact with the edges of switch indentation 126 prevents any potentially damaging lateral stopping force from being applied to plunger 120. Snap action switch 44 is a single-throw, normally open switch, preferably McGill part No. 4777-4200 or an engineering equivalent.

As thumb wheel 26 is rotated from the "Off" position in the increasing "On" direction, the engaging edge 128 engages and depresses plunger 120 of snap action switch 44. The depression of plunger 120 closes contacts (not shown) within snap action switch 44 allowing current to flow between the normally open quick connect terminal 130 and the common quick connect terminal 132, activating the wet/dry utility vacuum or blower motor. The thumb wheel outside wall 108 maintains the plunger 120 in the depressed position for all "On" operating positions, as shown in FIGS. 16 and 17.

The details of the electrical circuitry used to operate a motor apparatus utilizing the inventions disclosed herein should be known to one of ordinary skill in the art of motor construction, but are disclosed for completeness. Generally, a motor apparatus utilizing the benefits of the inventions disclosed herein will comprise, inter alia, a motor and a motor controller circuit board (not shown), which is typically mounted to the top of the motor. The snap action switch 44, when engaged, will allow power to flow to the motor controller board and to the motor, turning it on. The leads of the potentiometer 76 are also connected to the motor controller circuit board, and, when the controller board is powered by the snap action switch, can regulate the magnitude of the power supplied to the controller board, and therefore the speed of the motor.

As those of ordinary skill in the art will appreciate, the present invention is susceptible to various modifications and alternate forms. It should be understood, however, that it is not intended for the invention be limited to the particular forms disclosed. Further, it is intended that the invention cover all modifications, equivalents and alternatives falling within the spirit and scope of the invention defined by the appended claims.

What is claimed is:

1. A user operated switch and speed control assembly for an electronically controlled motor, comprising:

(a) an assembly mounting plate;

(b) a switch secured to the assembly mounting plate that turns the motor on and off;

(c) a voltage varying device secured to the assembly mounting plate that regulates the amount of power supplied to a high current motor controller circuit to thereby control the speed of the motor over a continuous range of predetermined motor speeds;

(d) a control member coupled to the voltage varying device and engageable with the switch, said control member including a thumb wheel having a journal portion, said control member adapted to activate the switch to turn the motor on and off and to adjust the voltage varying device to selectively vary the speed of the motor over said continuous range of predetermined motor speeds; and (e) at least one bearing that abuts the journal portion of the thumb wheel that absorbs mechanical shock coming from the thumb wheel without transferring the mechanical shock to the voltage varying device or the switch.

2. The user operated switch and speed control assembly according to claim 1, further comprising a spring that applies a counter force to the control member to automatically return the motor speed within the continuous range of predetermined motor speeds when the control member has been positioned to create a motor speed which exceeds the continuous range of predetermined motor speeds.

3. The user operated switch and speed control assembly according to claim 1, further comprising a static guard secured to the assembly mounting plate and electrically coupled to a ground plane to electrically isolate the electrical components of the voltage varying device from the portion of the control member exposed to the user of the device.

4. The user operated switch and speed control assembly according to claim 1, wherein the switch includes a snap action switch having a plunger engageable with the control member that allows electric current to flow to the motor when the control member is in an "On" position and prevents electric current from flowing to the motor when the control member is in an "Off" position.

5. The user operated switch and speed control assembly according to claim 1, wherein the voltage varying device includes a potentiometer having a shaft on which the control member is mounted.

6. The user operated switch and speed control assembly according to claim 1, wherein the thumb wheel includes one or more stops designed to contact various portions of the assembly mounting plate that correspond to various operational modes of the motor.

7. The user operated switch and speed control assembly according to claim 1, wherein the assembly mounting plate includes one or more stops designed to contact various portions of the thumb wheel that correspond to various operational modes of the motor.

8. A user operated switch and speed control assembly for an electronically controlled motor, comprising:

(a) an on/off switch for turning the motor on and off;

(b) a voltage varying device which cooperates with a high current motor controller for varying the speed of the motor over a continuous range of predetermined motor speeds;

(c) a control member for activating the on/off switch and adjusting the voltage varying device, said control member being coupled to said voltage varying device and engageable with said on/off switch; and (d) an electrical isolator member for electrically separating the electrical components of the device from the user, said electrical isolator member being electrically coupled to a ground plane of said motor.

9. The user operated switch and speed control assembly according to claim 8, wherein the control member is rotary.

10. The user operated switch and speed control assembly according to claim 8, further comprising a booster assembly for temporarily boosting the speed of the motor, said booster assembly being engageable with, and activated by, said control member.

11. The user operated switch and speed control assembly according to claim 8, wherein the on/off switch comprises a snap action switch having a plunger engageable with the control member.

12. The user operated switch and speed control assembly according to claim 8, wherein the voltage varying device includes a potentiometer having a shaft, said potentiometer being electrically coupled to said high current motor controller circuit.

13. The user operated switch and speed control assembly according to claim 12, wherein the control member includes a thumb wheel on the shaft of the potentiometer.

14. The user operated switch and speed control device according to claim 13, said thumb wheel including a spring engaging member, wherein the booster assembly includes a spring disposed within a spring receiving slot, the spring receiving slot having an opening that allows the spring engaging member of the thumb wheel to pass into the spring receiving slot and contact the spring so as to cause the spring to exert a counter-rotational force over a portion of the rotational range of the thumb wheel.

15. A user operated switch and speed control assembly for an electronically controlled motor, comprising:

(a) an assembly mounting plate;

(b) a switch secured to the assembly mounting plate that turns the motor on and off;

(c) a voltage varying device secured to the assembly mounting plate that regulates the amount of power supplied to a high current motor controller circuit to thereby control the speed of the motor over a continuous range of predetermined motor speeds;

(d) a control member coupled to the voltage varying device and engageable with the switch, said control member adapted to activate the switch to turn the motor on and off and to adjust the voltage varying device to selectively vary the speed of the motor over said continuous range of predetermined motor speeds; and (e) a spring that applies a counter force to the control member to automatically return the motor speed within the continuous range of predetermined motor speeds when the control member has been positioned to create a motor speed which exceeds the continuous range of predetermined motor speeds.

16. The user operated switch and speed control assembly according to claim 15, wherein the control member includes a thumb wheel having a journal portion and an engaging member.

17. The user operated switch and speed control assembly according to claim 16, further comprising at least one bearing that abuts the journal portion of the thumb wheel that absorbs mechanical shock coming from the thumb wheel without transferring the mechanical shock to the voltage varying device or the switch.

18. The user operated switch and speed control assembly according to claim 16, wherein the spring is disposed within a spring receiving slot formed in the assembly mounting plate, the spring receiving slot having an opening that allows the engaging member of the thumb wheel to pass into the spring receiving slot and contact the spring so as to cause the spring to exert a counter-rotational force over a portion of the rotational range of the thumb wheel.

19. The user operated switch and speed control assembly according to claim 18, wherein the thumb wheel and assembly mounting plate are each provided with a stop rib, said stop ribs cooperating to stop rotation of the thumb wheel before the spring is completely compressed.

20. The user operated switch and speed control assembly according to claim 15, further comprising an electrical isolator member for electrically separating the electrical components of the device from the user, said electrical isolator member being electrically coupled to a ground plane of said motor.

21. A user operated switch and speed control assembly for an electronically controlled motor, comprising:

(a) an assembly mounting plate;

(b) a switch secured to the assembly mounting plate that turns the motor on and off;

(c) a voltage varying device secured to the assembly mounting plate that regulates the amount of power supplied to a high current motor controller circuit to thereby control the speed of the motor over a continuous range of predetermined motor speeds;

(d) a control member coupled to the voltage varying device and engageable with the switch, said control member adapted to activate the switch to turn the motor on and off and to adjust the voltage varying device to selectively vary the speed of the motor over said continuous range of predetermined motor speeds; and (e) a static guard secured to the assembly mounting plate and electrically coupled to a ground plane to electrically isolate the electrical components of the voltage varying device from the portion of the control member exposed to the user of the device.

22. The user operated switch and speed control assembly according to claim 21, wherein the control member includes a thumb wheel having a journal portion.

23. The user operated switch and speed control assembly according to claim 22, wherein the thumb wheel includes one or more stops designed to contact various portions of the assembly mounting plate that correspond to various operational modes of the motor.

24. The user operated switch and speed control assembly according to claim 22. wherein the assembly mounting plate includes one or more stops designed to contact various portions of the thumb wheel that correspond to various operational modes of the motor.

25. The user operated switch and speed control assembly according to claim 22, further comprising at least one bearing that abuts the journal portion of the thumb wheel that absorbs mechanical shock coming from the thumb wheel without transferring the mechanical shock to the voltage varying device or the switch.

* * * * *